US005716016A

United States Patent [19]

Iwade et al.

[11] Patent Number: 5,716,016

[45] Date of Patent: Feb. 10, 1998

[54] TURRET TYPE YARN WINDER WITH REDUCED TENSION VARIATION DURING SWITCHING

[75] Inventors: Takashi Iwade, Kyoto; Yoshiro Migaki; Jun Takagi, both of Otsu, all of Japan

[73] Assignee: Toray Engineering Co., Ltd., Osaka, Japan

[21] Appl. No.: 493,829

[22] Filed: Jun. 22, 1995

[30] Foreign Application Priority Data

Jun. 27, 1994 [JP] Japan ..... 6-169008

[51] Int. Cl.[6] ..... B65H 54/00; B65H 67/44

[52] U.S. Cl. ..... 242/18 A; 242/18 R; 242/25 A

[58] Field of Search ..... 242/18 A, 25 A, 242/18 EW, 18 PW, 18 R

[56] References Cited

U.S. PATENT DOCUMENTS

| | | | |
|---|---|---|---|
| 3,792,818 | 2/1974 | Bauer et al. | 242/18 PW |
| 4,083,505 | 4/1978 | Burkhardt | 242/18 PW |
| 4,146,186 | 3/1979 | Burkhardt | 242/18 PW |
| 4,210,293 | 7/1980 | Fromaget | 242/18 A |
| 4,491,282 | 1/1985 | Hubner | 242/28 PW |
| 4,496,109 | 1/1985 | Cardell | 242/18 R |

FOREIGN PATENT DOCUMENTS

| | | | |
|---|---|---|---|
| 0650914 | 5/1994 | European Pat. Off. . | |
| 2907848 | 2/1979 | Germany . | |
| 50-13858 | 5/1975 | Japan . | |
| 50-46034 | 12/1975 | Japan . | |
| 62-196267 | 8/1987 | Japan . | |
| 290686 | 12/1987 | Japan | 242/18 R |
| 1104576 | 4/1989 | Japan . | |
| 231770 | 9/1989 | Japan | 242/18 R |

OTHER PUBLICATIONS

Advertisement re TW-555RA, Fiber Producer, Aug. 1979.

Advertisement re Rieter Concept, Rieter Machine Works, Ltd. CH-8406 Winterthur, Switzerland.

*Primary Examiner*—William Stryjewski

*Attorney, Agent, or Firm*—Greer, Burns & Crain, Ltd.

[57] ABSTRACT

To improve the success rate of yarn switching by reducing the variation of the winding tension during the yarn switching operation, a turret type yarn winder is provided, wherein the upper yarn switching mechanism 8 and the lower yarn switching mechanism 9 are provided at positions wherein, when the empty bobbin 50 held by the spindle 4 is displaced by the rotation of the turret member 2 toward the yarn 60 supported by the respective yarn path restriction guides of the yarn switching mechanisms 8, 9, the circumference of the empty bobbin 50 is brought into contact with the yarn 60 at a contacting angle, which angle increases as the turret member rotates, and wherein the dog portion 30 mounted to the turret member 2 causes the yarn searching guide 25 of the lower yarn switching mechanism 9 to rotate in synchronism with the rotation of the turret member 2, and the guide plate 31 for forming the anchor yarn winding is actuated to move the yarn 60 in the axial direction of the bobbin 50.

3 Claims, 15 Drawing Sheets

TURRET TYPE YARN WINDER WITH REDUCED TENSION VARIATION DURING SWITCHING

BACKGROUND OF THE INVENTION

1. Field of the Invention

The present invention relates to a turret type yarn winder for continuously winding a yarn.

2. Description of the Related Art

Generally speaking, a synthetic fiber yarn spun from a spinning machine is taken up by a turret type yarn winder, for example, described in Japanese Unexamined Patent Publication (Kokai) 1-104576.

The turret type yarn winder disclosed in the above publication is provided with a turret member having a plurality of rotatable spindles, and rotatably held on a machine frame, a traverse mechanism provided above the spindles, a contact roller to be brought into contact with a bobbin held on the spindle or a yarn layer wound on the bobbin for applying a predetermined pressure thereto, an upper yarn switching mechanism provided above the traverse mechanism or the contact roller, a lower yarn switching mechanism provided between a full bobbin and an empty bobbin for restricting a yarn path when a yarn is switched from the full bobbin to the empty bobbin, a threading mechanism provided beneath the lower yarn switching mechanism for restricting the yarn path at the beginning of yarn winding on the empty bobbin, and an anchor yarn winding mechanism movable into a space between the empty bobbin and the lower yarn switching mechanism or between the empty bobbin and the threading mechanism, for winding the yarn on the empty bobbin, whereby the yarn is switched from the full bobbin to the empty bobbin by the rotation of the turret member while the yarn is guided via yarn path restricting guides of the upper and lower yarn switching mechanisms so that the yarn is brought into contact with the empty bobbin held on the spindle.

When a yarn winding speed of the above turret type yarn winder exceeds 4,000 m/min, the threading operation is conducted with the yarn winding speed being less than about 3,000 m/min, because a maximum yarn take-up capacity of a suction gun is about 3,000 m/min. In this operation, when the yarn is caught by a yarn catching part, a bunch winding and a tail winding are formed. Then, the yarn is wound on the empty bobbin, while being traversed by the traverse mechanism. Simultaneously therewith, the rotational speed of the spindle is accelerated in synchronism with a godet roller so that a predetermined winding speed is attained.

In the above operation, the yarn is wound on the empty bobbin to form a thin layer bobbin.

Since a yarn in the thin layer bobbin is deteriorated in qualities, it is regarded as an inferior yarn.

Accordingly, it is necessary to switch the yarn from the thin layer bobbin to another empty bobbin by the rotation of the turret member when the rotational speed of the spindle reaches the predetermined yarn winding speed.

When the threading operation is conducted in the above manner, two kinds of steps are necessary; yarn switching from the thin layer bobbin to the empty bobbin and that from the full bobbin to the empty bobbin.

For the purpose of stabilizing the yarn path during the yarn switching operation, the yarn switching operation can be conducted, while elevating the rotational speeds of the full bobbin spindle and the empty bobbin spindle so that a yarn tension is increased.

According to the above-mentioned turret type yarn winder, as shown in FIG. 21, a second yarn path restriction guide 70 is inserted between the empty bobbin 50 and the full bobbin 51. As a contacting angle with the empty bobbin 50 of the yarn 60, supported by the respective yarn path restriction guides of the upper yarn switching mechanism (not shown) and the lower yarn switching mechanism, increases due to the rotation of the turret member (not shown), a contacting angle of the yarn 60 at the second yarn path restriction guide 70 becomes minimum at a time of yarn switching from the thin bobbin to the empty bobbin and maximum at a time of yarn switching from the full bobbin to the empty bobbin, because the second yarn path restriction guide 70 of the lower yarn switching mechanism is located at a position on the full bobbin side relative to a common tangent formed between a position formed on a circumference (E) of an outermost yarn layer of the full bobbin and located on a forward side thereof which is relative to a rotational direction of the turret member and a position formed on a circumference (D) of an outermost yarn layer of the bobbin empty and located on a forward side thereof which is relative to a rotational direction of the turret member.

Thereby, as shown in FIG. 22, during the yarn switching operation from the full bobbin to the empty bobbin, a tension drop (θ) occurs when the yarn 60 is brought into contact with a second yarn path restricting guide 70, which results in the yarn vibration and/or the yarn wrap around the godet roller to deteriorate the success rate of the yarn switching operation.

Also, since the winding tension is elevated during the yarn switching operation from the full bobbin to the empty bobbin due to the increase of the spindle rotational speed, a quality difference exists between the outermost layer yarn and the inner layer yarn of the full bobbin, whereby a large amount of the outermost layer yarn must be removed from the full bobbin, as a waste.

SUMMARY OF THE INVENTION

An object of the present invention is to solve the above problems and improve the success rate of the yarn switching operation by minimizing the tension variation during the yarn switching operation.

A turret type yarn winder according to the present invention essentially has the following technical arrangement for the purpose of achieving the above object. That is, the turret type yarn winder comprises a turret member rotatably mounted to a machine frame and having a plurality of rotatable spindles for holding bobbins, a traverse mechanism provided above the spindles, a contact roller rotatably mounted on the machine frame or a frame of the traverse mechanism, an upper yarn switching mechanism provided upstream of the contact roller, and a lower yarn switching mechanism capable of moving into a space formed between a full bobbin and an empty bobbin, wherein the lower yarn switching mechanism is provided with an anchor yarn winding mechanism.

As a more concrete aspect of the present invention, a turret type yarn winder is provided, comprising a turret member rotatably mounted on a machine frame and having a plurality of rotatable spindles for holding bobbins, a traverse mechanism provided above the spindles, a contact roller rotatably mounted on the machine frame or a frame of the traverse mechanism, an upper yarn switching mechanism provided upstream of the spindle located in the yarn winding position, and a lower yarn switching mechanism capable of moving into a space formed between a full bobbin and an empty bobbin, wherein the lower yarn switching mechanism comprises an outer bunch forming guide for guiding a running yarn to a predetermined position on the outer circumference of the yarn layer formed on the bobbin to form a bunch winding and a yarn searching guide for guiding the yarn running along a yarn path restricted by the upper yarn switching mechanism, to the yarn catching part of the bobbin, wherein when the outer bunch forming guide is displaced into a space formed between the full and empty bobbins under a condition in that the empty bobbin is moved to a yarn switching position in the vicinity of the yarn winding position due to the turret member to be rotated in a direction opposite to the rotational direction of the spindle, the outer bunch forming guide is located on the empty bobbin side relative to a common tangent formed between a position formed on a circumference of an outermost yarn layer of the full bobbin and located on a forward side thereof which is relative to a rotational direction of the turret member and a position formed on a circumference of an outermost yarn layer of the empty and located on a forward side thereof which is relative to a rotational direction of the turret member.

According to the above turret type yarn winder, since when the outer bunch forming guide is displaced into the space formed between the full and empty bobbins under the condition in that the empty bobbin is moved to a yarn switching position in the vicinity of the yarn winding position, due to the turret member to be rotated in a direction opposite to the rotational direction of the spindle, the outer bunch forming guide is located on the empty bobbin side relative to a common tangent formed between the circumference of the outer most yarn layer on the full bobbin provided on the rotational portion of the turret member and the circumference of the empty bobbin provided on the rotational portion of the current member, whereby the yarn is engageable with the yarn catching part of the empty bobbin if the yarn searching guide of the lower yarn switching mechanism is displaced in the axial direction of the bobbin in synchronism with the rotation of the turret member.

DETAILED DESCRIPTION OF THE PREFERRED EMBODIMENTS

A turret type yarn winder according to the present invention will be described in more detail with reference to the preferred embodiments illustrated in the attached drawings.

Figure 1:
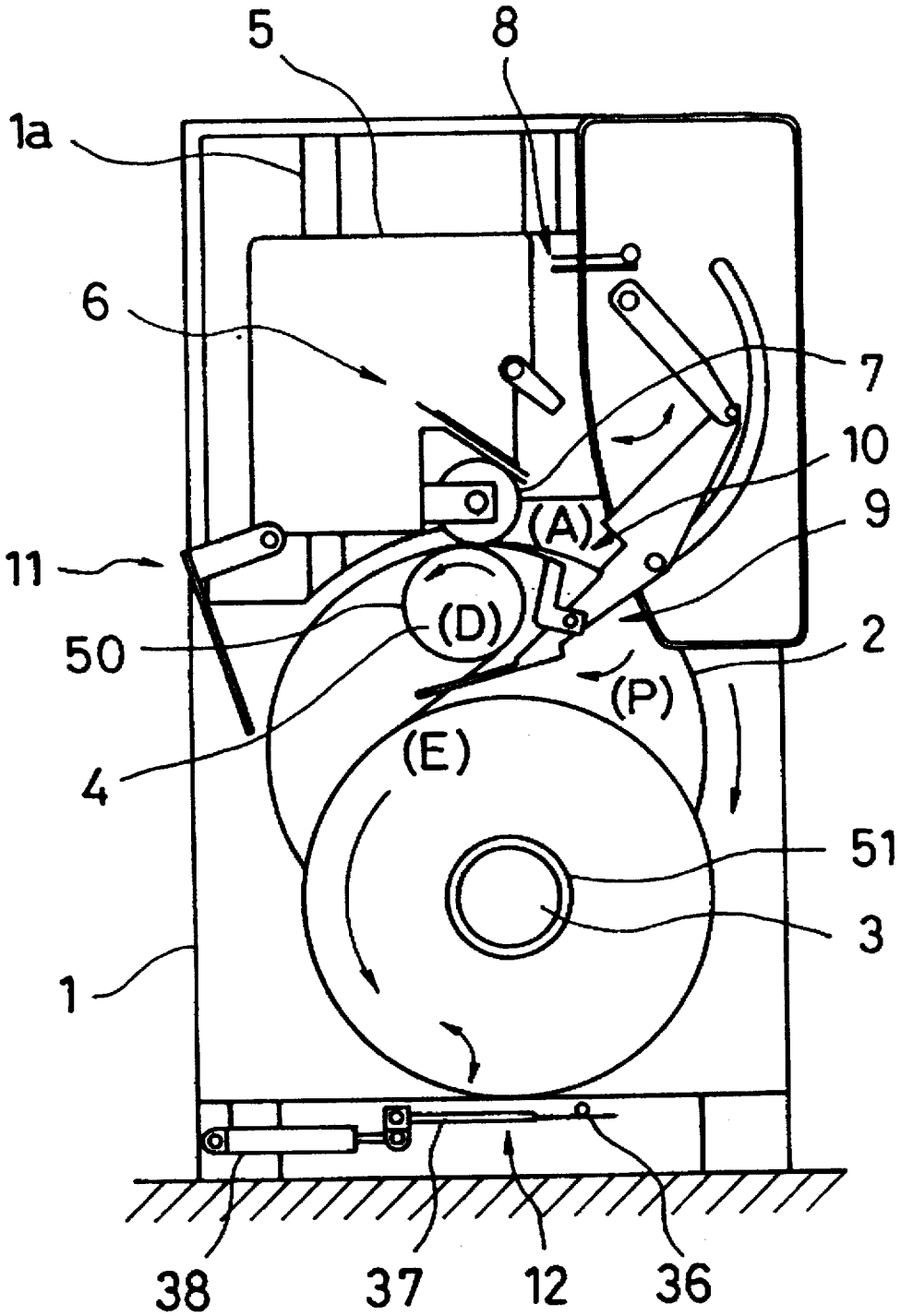
FIG. 1 is a schematic front view of one embodiment of a turret type yarn winder according to the present invention.
Figure 2:
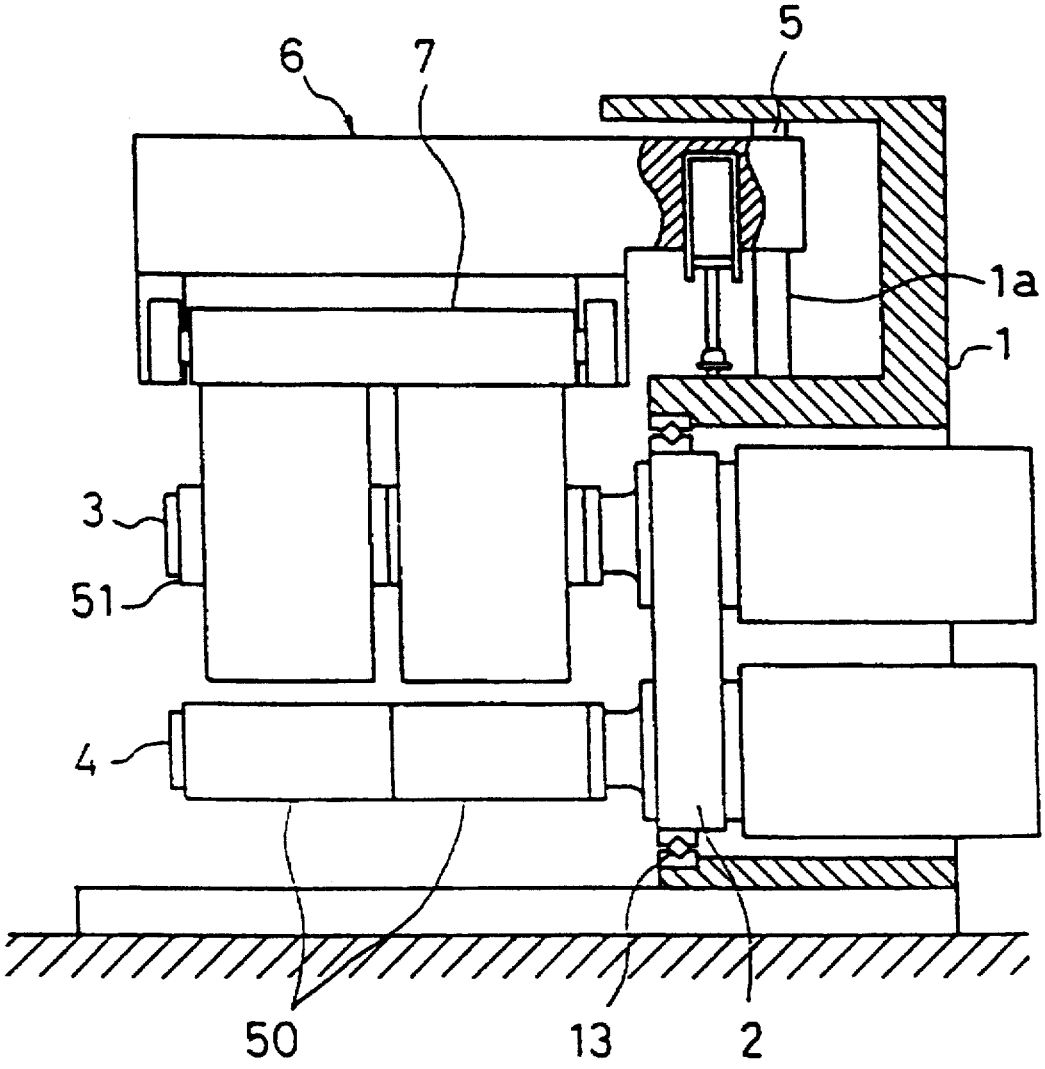
FIG. 2 is a schematic side view of FIG. 1.

FIG. 1 is a schematic front view of one embodiment of a turret type yarn winder according to the present invention, and FIG. 2 is a schematic side view thereof, wherein the yarn winder is structured by a turret member 2 rotatably mounted on a machine frame 1, spindles 3, 4 rotatably mounted on the turret member 2, for supporting bobbins, a traverse mechanism 6 located above the spindles 3, 4 and attached to a frame body 5 movable in the vertical direction along a guiding pillar la provided in the machine frame 1, a contact roller 7 rotatably mounted on the frame body 5, an upper yarn switching mechanism 8 provided on the machine frame 1 and oppositely arranged to the contact roller 7 and the frame body 5 provided above the traverse mechanism 6, with a predetermined space interposed therebetween, a lower yarn switching mechanism 9 mounted on the machine frame 1 to be movable into a space formed between a full bobbin 51 and an empty bobbin 50, an anchor yarn winding mechanism 10 mounted on the lower yarn switching mechanism 9 to be movable into a recess (A) formed between the contact roller 7 and the empty bobbin 50 located at a yarn winding position, a partitioning mechanism 11 provided on the machine frame 1 to be positioned between the empty bobbin 50 and the lower yarn switching mechanism 9 when the yarn switching operation is carried out, and a threading mechanism 12 provided on the machine frame 1 at a position beneath the lower yarn switching mechanism 9 to restrict a yarn path so that a yarn is wound on the empty bobbin 50 at an initial stage of the yarn winding operation.

The above-mentioned turret member 2 is rotatably mounted on the machine frame 1 by a bearing 13 to be driven to make a rotation of 180° in the direction P by a driving means (not shown), when the bobbin held on the spindle 3 positioned at a yarn winding position becomes full, so that the spindle 4 carrying the empty bobbin 50 positioned at a bobbin doffing position is displaced to the yarn winding position.

Figure 8:
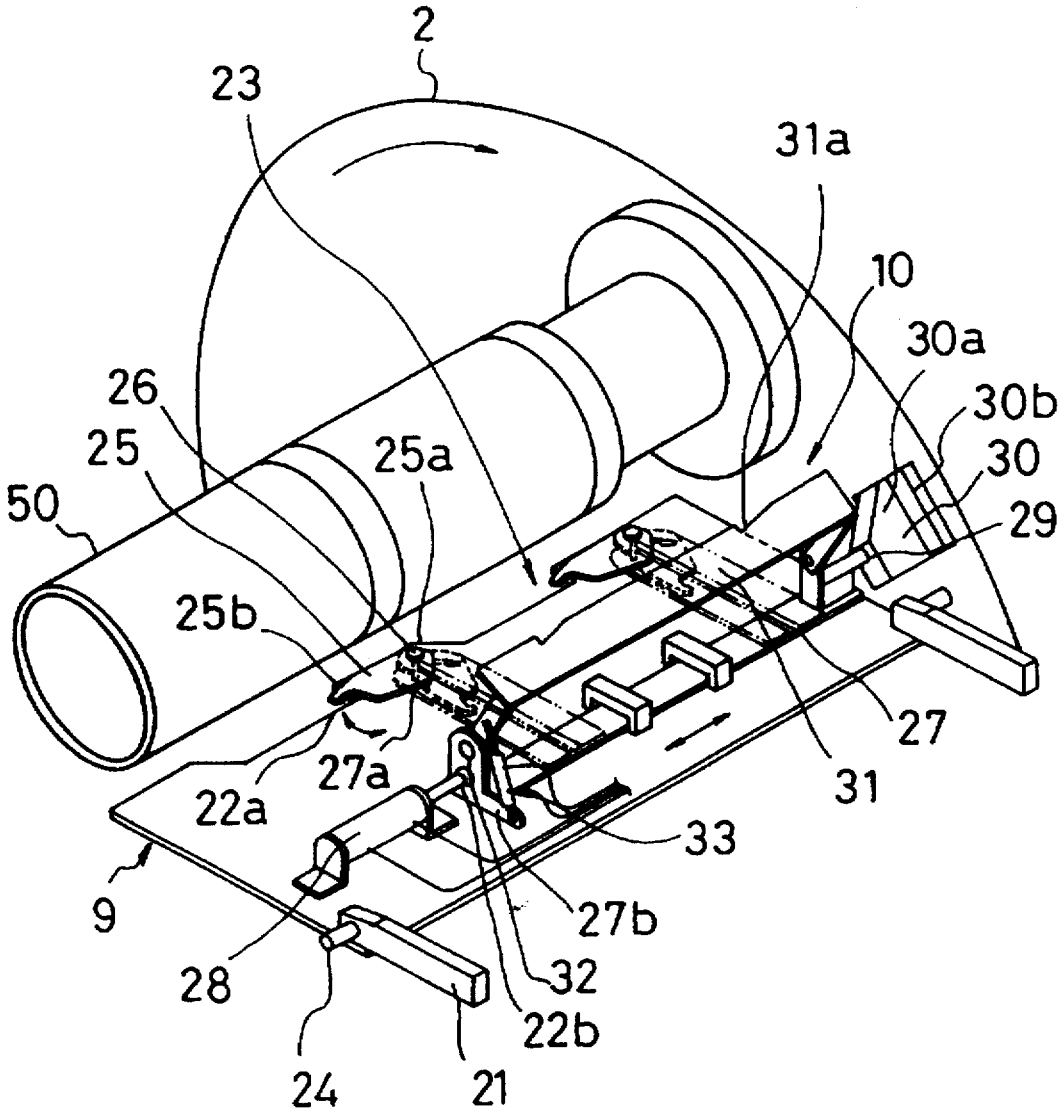
FIG. 8 is a schematic perspective view of FIG. 4.

As shown in FIG. 8, a dog portion 30 having a slanted guide surface **30*a* is provided on the turret member 2 at a position in the vicinity of the spindles 3 and 4, which position is adjustable through an elongated hole 30*b***.

The spindle 3 or 4 has such a structure as disclosed in Japanese Examined Patent Publication (Kokoku) 50-13858, Japanese Examined Utility Model Publication (Kokoku) 50-46034 or Japanese Unexamined Patent Publication (Kokai) 62-196267.

The traverse mechanism 6 may be displaced to a predetermined yarn winding position by a rocking motion or an elevation/descent along a slanted path. The traverse mechanism 6 has a structure wherein a yarn guide for traversing the yarn is made so as to reciprocate it by a scroll cam roller or the yarn is directly reciprocated by a plurality of rotary blades.

The contact roller 7 may be positively driven by a motor or passively driven by a frictional force from a yarn layer formed on the bobbin held on the spindle 3 or 4.

Figure 3:
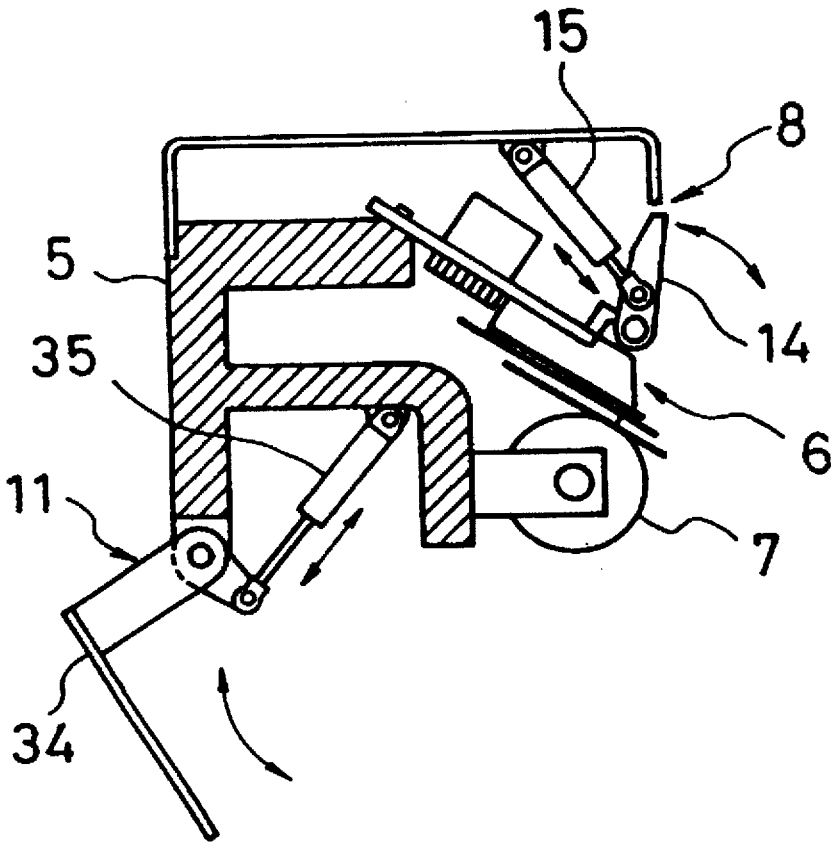
FIG. 3 is a schematic enlarged view of part of FIG. 1.
Figure 4:
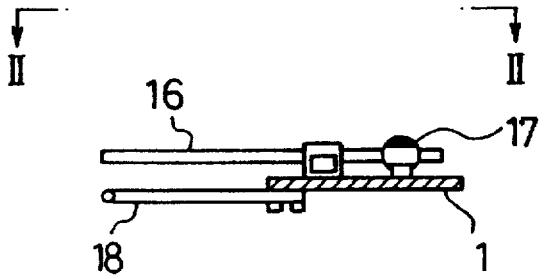
FIG. 4 is a schematic enlarged view showing a structure of an upper yarn switching mechanism in FIG. 1.
Figure 5:
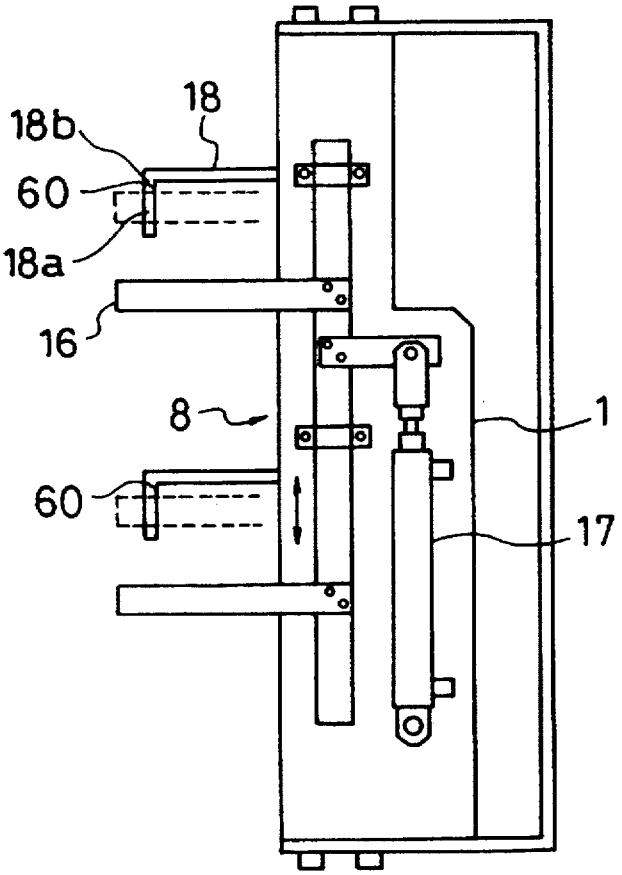
FIG. 5 is a view as seen in the arrowed direction II—II in FIG. 4.

The upper yarn switching mechanism 8 is specifically illustrated in FIGS. 3, 4 and 5, wherein this mechanism 8 is rotatably mounted on the frame body 5 at a position above the traverse mechanism 6 and includes a yarn releasing guide 14 movable in the direction perpendicular to the yarn running direction and the yarn traversing direction by a cylinder 15, a yarn pushing guide 16 provided on the machine frame 1 to be opposite to the yarn releasing guide 14 so as to form the yarn path between the guides 14 and 16 and movable in the axial direction of the empty bobbin 50 by a cylinder 17, and a yarn supporting guide 18 mounted on the frame body 5 to be located beneath the yarn pushing guide 16 when the yarn pushing guide 16 is shifted to a bunch winding position and a tail winding position on the empty bobbin, for supporting the yarn.

The yarn pushing guide 16 and the yarn supporting guide 18 may be provided on the frame body 5.

The yarn supporting guide 18 is provided with a supporting section 18*a* and a guiding section 18*b* having an L-shaped portion for guiding the yarn to the bunch winding position.

When the bobbin located at the yarn winding position becomes full, the yarn releasing guide 14 is projected by the cylinder 15 whereby the yarn is pushed out from a traverse guide 6*a* of the traverse mechanism 6.

Figure 15:
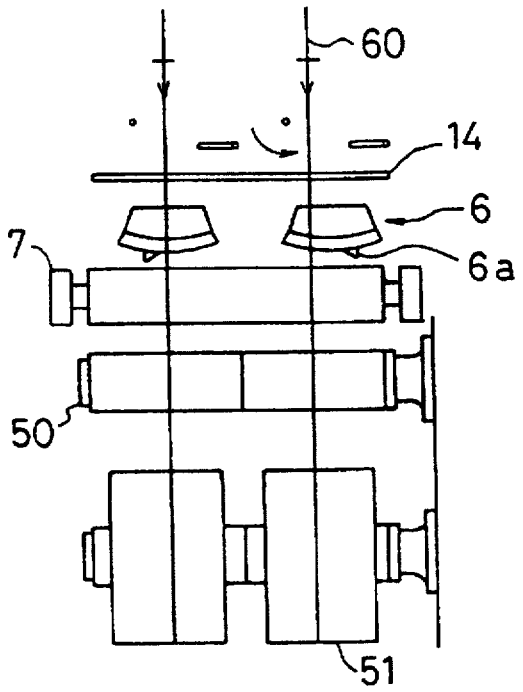
FIGS. 15, 16, 17 and 18 are schematic views showing yarns paths during the yarn switching operation in the turret type yarn winder according to the present invention.

Then, the yarn pushing guide 16 moves toward one end of the full bobbin 51 by the cylinder 17 and the yarn 60 released from the traverse guide 6*a* FIG. 15 is conveyed to the end of the empty bobbin 50. The yarn 60 is guided by the yarn supporting guide 18 to a yarn catching part (B) FIG. 18 such as a yarn catching groove formed on the empty bobbin, a boundary between abutting ends of adjacent empty bobbins held on the spindle or a boundary between the bobbin end and a shoulder for positioning the bobbin abutting the former.

Figure 6:
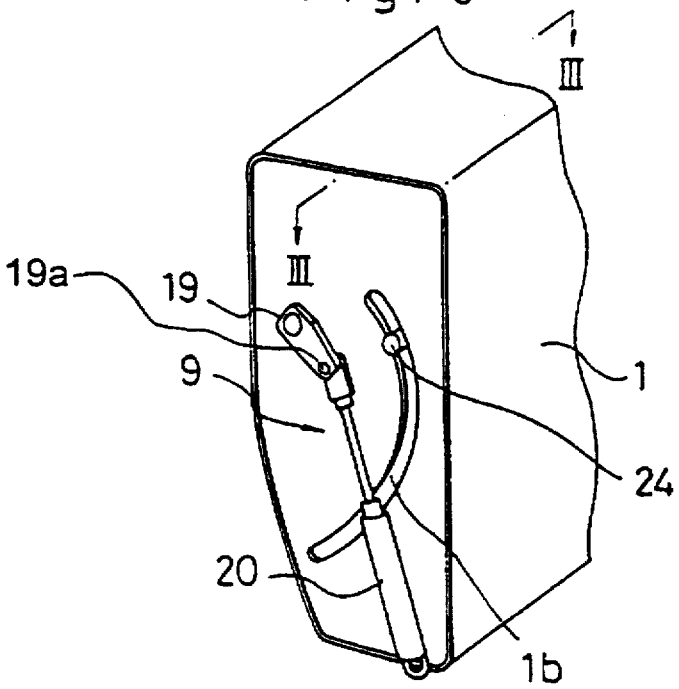
FIG. 6 is a schematic enlarged view showing a structure of a lower yarn switching mechanism in FIG. 1.
Figure 7:
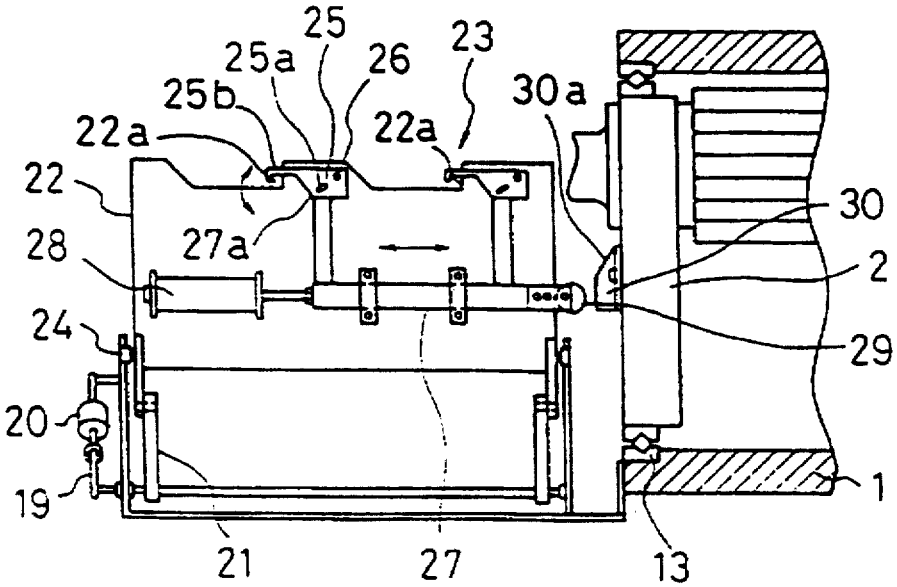
FIG. 7 is a view as seen in the arrowed direction III—III in FIG. 6.

Details of the lower yarn switching mechanism 9 are illustrated in FIGS. 6, 7 and 8, which includes an arm 19 rotatably mounted on the machine frame 1, a cylinder 20 for rotating the arm 19, a swing arm 21 integrally secured to a lever section 19*a* of the arm 19, a partitioning plate 22 rotatably mounted on the swing arm 21, and a yarn searching mechanism 23 movably mounted on the partitioning plate 22.

A cam follower 24 is provided on on the lateral side of the partitioning plate 22 and engaged with a guiding groove lb formed on the machine frame 1.

A guide section 22*a* is formed at a free end of the partitioning plate 22 for forming an outer bunch at a predetermined position on the outermost yarn layer wound on the bobbin.

When the arm 19 rotates by the action of the cylinder 20, the partitioning plate 22 moves along a guiding groove l*a* provided on the machine frame 1 to displace the guide section 22*a* for forming the outer bunch to a yarn switching position between the full bobbin 51 and the empty bobbin 50.

The yarn searching mechanism 23 includes a yarn searching guide 25 rotatably mounted on the partitioning plate 22 by a pin 26, a bar 27 inserted into a guide portion 22*b* formed on the partitioning plate 22 and being movable in the axial direction of the bobbin by a cylinder 28, and a roller 29 rotatably mounted on one end of the bar 27 to be engaged in a dog portion 30 provided on the turret member 2.

The roller 29 must be mounted on the bar 27 so that a predetermined gap is formed between the roller and the dog portion 30 not to abut to each other when the turret member 2 rotates, while, during the yarn switching operation, the roller 29 abuts to the dog portion 30 at a predetermined pressure by the cylinder 28.

The yarn searching guide 25 includes a pin section 27*a* projected from the bar 27 engaged in an elongated hole 25*a* formed in the guide 25, and when the turret member 2 rotates to displace empty bobbin 50 to a preliminarily set position, the roller 29 of the bar 27 abuts to the dog portion 30 by the cylinder 28.

As the turret member 2 rotates, the bar 27 moves along the slanted guide surface 30*a* formed on the dog portion 30 to rotate the yarn searching guide 25 about the pin 26, whereby the yarn 60 is displaced in the axial direction of the empty bobbin 50 and engaged in the yarn catching part (B).

The anchor yarn winding mechanism 10 includes an anchor yarn winding guide plate 31 rotatably mounted on the supporting section 27*b* of the bar 27 by a pin 32 and a cylinder 33 for rotating the anchor yarn winding guide plate 31 between an anchor yarn winding position and a waiting position. A guiding section 31*a* for restricting a yarn path, is formed at an edge of the anchor yarn winding guide plate 31.

When the yarn is switched, the arm 19 is made to be rotated by the cylinder 20 and the partitioning plate 22 is displaced along the guide groove 1*b* of the machine frame 1. This causes the outer bunch forming guide section 22*a* to move to a yarn switching position formed between the full bobbin 51 and the empty bobbin 50. Then, when the guiding section 31*a* for restricting a yarn path is rotated to move to an anchor yarn winding position by the rotation of the anchor yarn winding guide plate 31 by the action of the cylinder 33, the roller 29 on the bar 27 abuts to the dog portion 30 by the action of the cylinder 28, when the bar 27 moves in the axial direction of the empty bobbin 50 in accordance with the rotation of the turret member 2, the yarn searching guide 25 rotates about the pin 26 to convey the yarn 60 across the yarn catching part (B).

Simultaneously with the rotation of the yarn searching guide 25, the guide section 31*a* of the anchor yarn winding guide plate 31 moves in the axial direction of the empty bobbin 50 to guide the yarn 60 across a vertical line on the yarn catching part (B) by the yarn searching guide 25 and the guide section 31*a* for restricting the yarn path.

As illustrated in FIG. 3, the partitioning mechanism 11 includes a partitioning plate 34 rotatably mounted on the machine frame 1 and a cylinder 35 for displacing the partitioning plate 34 between a yarn switching position formed between the empty bobbin 50 and the lower yarn switching mechanism 9 and a waiting position.

The threading mechanism 12 includes a supporting bar (not shown) mounted on the machine frame 1 in a rotatable and axially movable manner at a position beneath the lower yarn switching mechanism 9, an arm 37 mounted on the supporting bar and having a threading guide 36 at one end thereof, and a cylinder 38 for rotating the supporting bar to displace the threading guide 36 between a threading position and a waiting position.

After the yarn 60 is threaded to the threading guide 36 at the beginning of the yarn winding operation, the threading guide 36 is rotated together with the supporting bar (not shown) to the threading position so that the yarn 60 runs on the yarn catching part (B).

A portion of the guide section 22*a* or 31*a* in contact with the yarn is preferably formed of a guide member made of ceramics or alumina.

Each of the above-mentioned cylinder is coupled with a duct for supplying pressurized air (not shown) having an electro-magnetic valve which is controlled by a signal from a controller so that the air flow path is switched to plunge out or in a piston rod of the cylinder.

The anchor yarn winding mechanism 10 is provided preferably on the lower yarn switching mechanism 9 but may be mounted on the machine frame 1 or eliminated.

An outline of the yarn switching operation from the full bobbin to the empty bobbin in the above turret type yarn winder, will be explained with reference to FIGS. 9 through 18.

Figure 9:
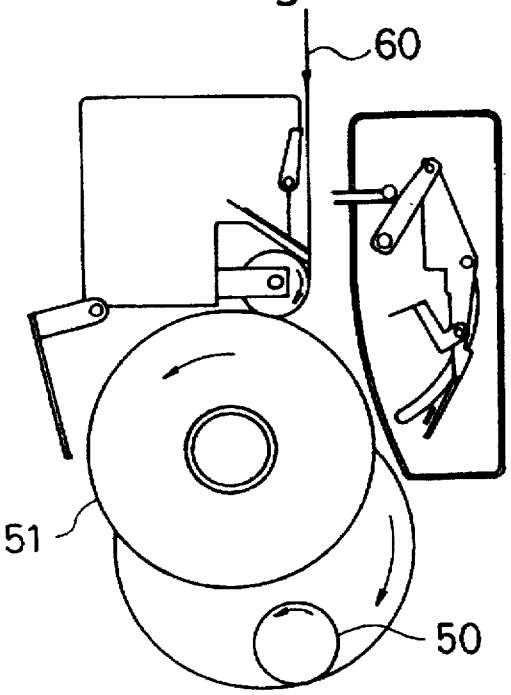
FIGS. 9, 10, 11, 12, 13 and 14 are schematic views showing the steps of a yarn switching operation in the turret type yarn winder according to the present invention.

In the above turret type yarn winder, when a predetermined amount of yarn 60 is taken up on a bobbin to form a full bobbin as shown in FIG. 9, the spindle 4 carrying the empty bobbin 50 is made to rotate and the turret member 2 rotates to bring the full bobbin 51 positioned at the yarn winding position to the bobbin doffing position, while the empty bobbin 50 positioned at the bobbin doffing position rotates to the yarn winding position.

Figure 10:
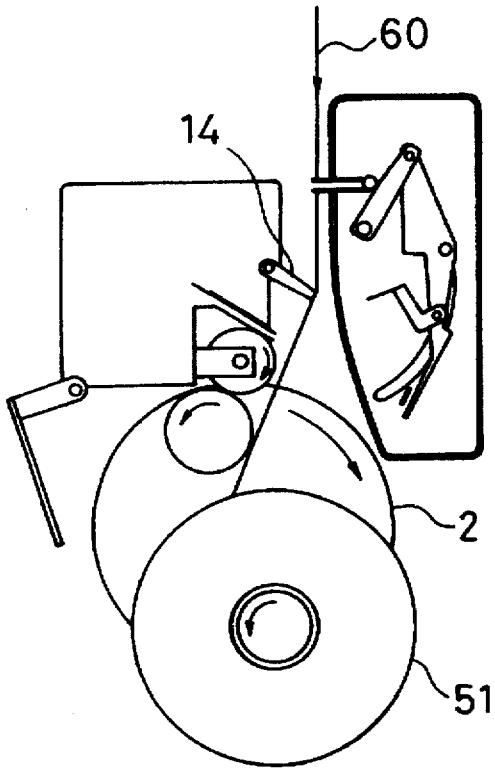

As shown in FIG. 10, when the empty bobbin 50 moves to an intermediate stop position in front of the yarn winding position and the rotational movement of the turret member 2 is stopped, the cylinder 15 for the upper yarn switching mechanism 8 is actuated to rotate the yarn releasing guide 14, whereby the yarn is pushed out from the traverse guide 6*a*. The yarn path at this instant is as shown in FIG. 15.

Figure 11:
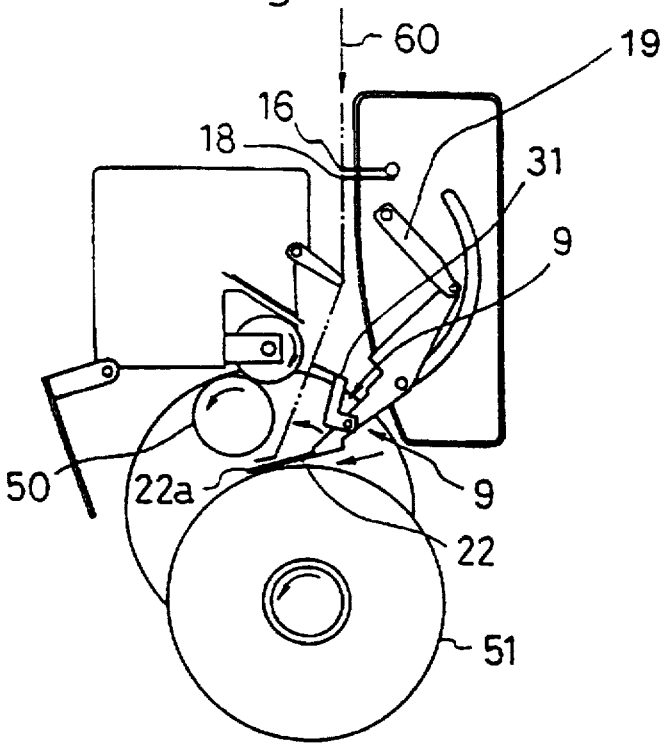

Then, as shown in FIG. 11, the cylinder 20 for the lower yarn switching mechanism 9 is actuated to rotate the arm 19, whereby the guide section 22*a* of the partitioning plate 22 is located at a yarn switching position formed between the empty bobbin 50 and the full bobbin 51. Thereafter, the cylinder 17 for the upper yarn switching mechanism 8 is actuated to displace the yarn pushing guide 16, whereby the yarn 60 is conv supporting section 18*a* and the guide section 18*b* of the yarn supporting guide 18, as shown by a dotted line in FIG. 5.

Figure 16:
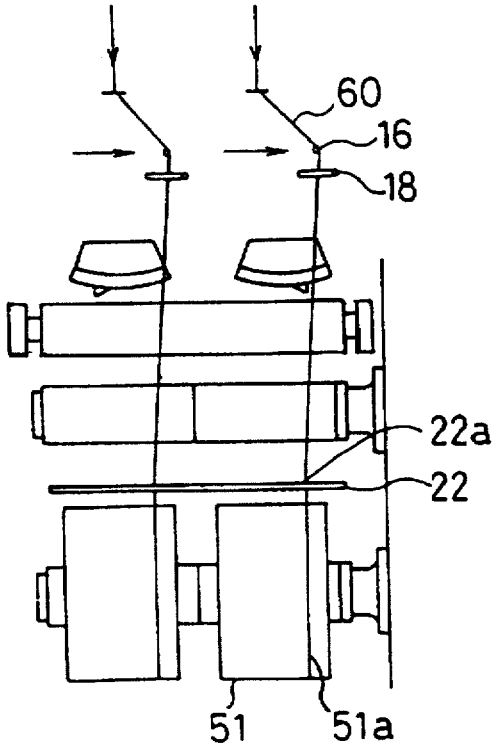

According to the above mentioned operation, the yarn 60 is guided to an outer bunch winding position 51*a* on the outermost yarn layer of the full bobbin 51 by the yarn pushing guide 16, the yarn supporting guide 18 and guide section 22*a* of the partitioning plate 22 and wound thereon. The yarn path at this instant is as shown in FIG. 16.

Figure 12:
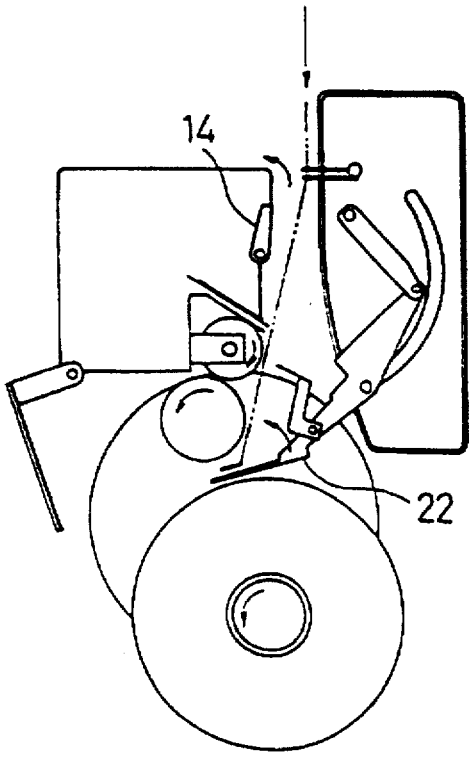

Thereafter, the cylinder 33 for the anchor yarn winding mechanism 10 is actuated to rotate the guide section 31*a* of the anchor yarn winding guide plate 31 to an anchor yarn winding position, and, as shown in FIG. 12, the cylinder 15 of the upper yarn switching mechanism 8 is actuated to return the yarn releasing guide 14 to the waiting position.

At this instant, the yarn 60 is wound while running along a tangent common to the circumference (D) of the empty bobbin 50 and the circumference (E) of the outermost yarn layer of the full bobbin 51.

Then, the cylinder 28 of the lower yarn switching mechanism 9 is actuated to displace the bar 27 by a distance corresponding to the gap so that the roller 29 abuts to the dog portion 30.

The yarn searching guide 25 is made to rotate counterclockwise-direction about the pin 26 as shown by a dotted line in FIG. 8 to bring the yarn catching section 25*b* to a predetermined position, due to the moving operation of the bar 27.

Figure 13:
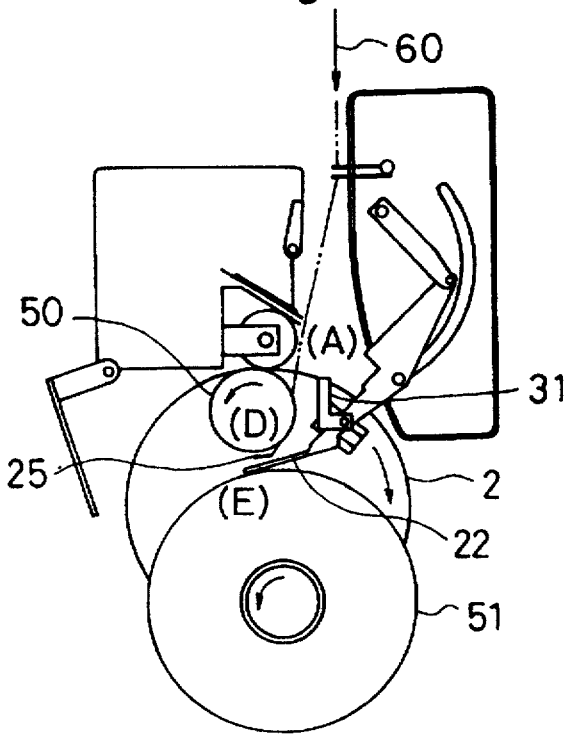

As shown in FIG. 13, when the turret member 2 is made to rotate to bring the empty bobbin 50 to the yarn winding position and the full bobbin 51 to the bobbin doffing position, the yarn 60 is brought into contact with the circumference of the empty bobbin 50.

Figure 17:
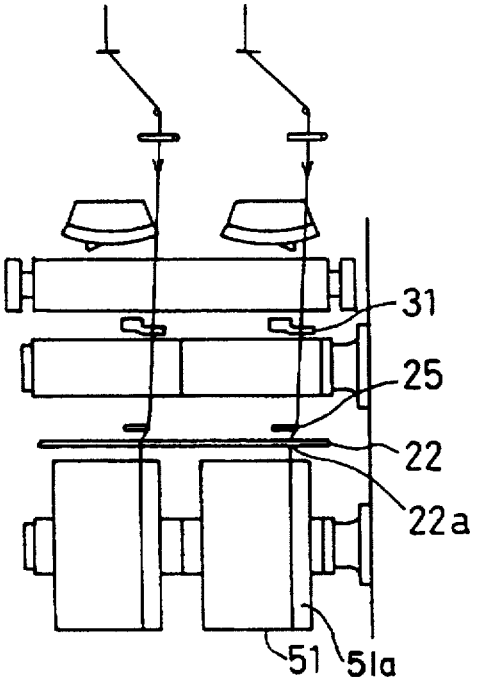

By the displacement of the dog portion 30 in accordance with the rotation of the turret member 2, the bar 27 moves along the slanted guide surface 30*a* toward the base end of the spindle, and the yarn searching guide 25 is made to rotate counterclockwise-direction about the pin 26 to displace the yarn catching section 25*b* to a position shown by a dotted line as shown in FIG. 8. Simultaneously therewith, the anchor yarn winding guide plate 31 is displaced together with the bar 27. At this instant, the yarn path is as shown in FIG. 17.

Figure 14:
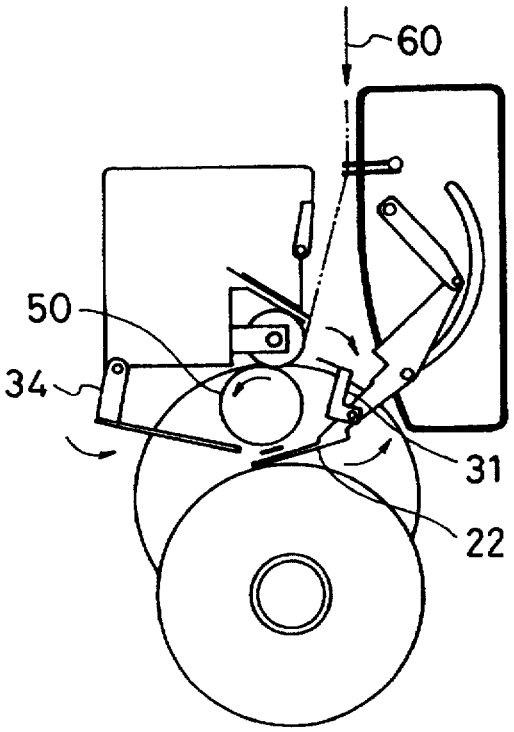
Figure 18:
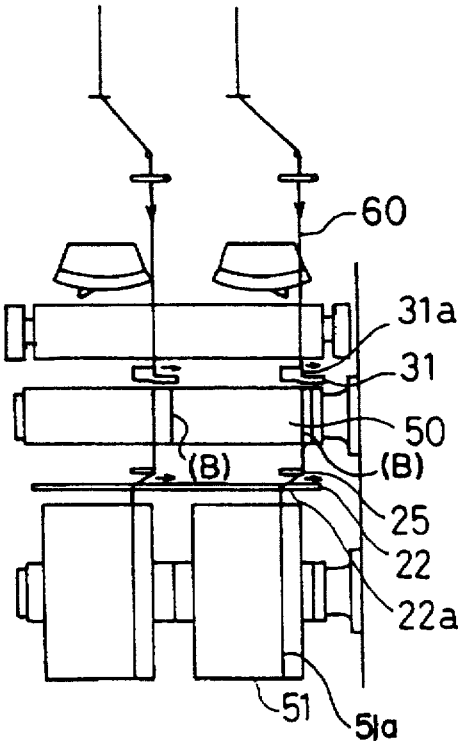

Accordingly, as shown in FIG. 14, the yarn 60 running toward the outer bunch winding position via the yarn catching section 25*b* of the yarn searching guide 25 and the guide section 31*a* of the anchor yarn winding plate 31 is moved across the yarn catching part (B) and caught thereby. At this instant, the yarn path is as shown in FIG. 18.

When the yarn is caught by the yarn catching part (B), the yarn is severed due to a tension at a position between the same and the full bobbin 51.

When the yarn 60 is caught by the yarn catching part (B), the cylinder 17 for the upper yarn switching mechanism 8 is actuated to return the yarn pushing guide 16 to the waiting position.

When the pushing guide 16 is displaced, the yarn 60 moves along the supporting section 18*a* of the yarn supporting guide 18 to form a tail winding on the empty bobbin 50. After being released from the supporting section 18*a*, the yarns 60 is engaged in the traverse guide 6*a* of the traverse mechanism and wound on the empty bobbin 50 while being traversed thereby.

On the other hand, when the yarn 60 is caught by the yarn catching part (B), the cylinder 33 of the anchor yarn winding mechanism 10 is actuated to return the anchor yarn winding guide plate 31 to the waiting position.

Then, when the rotation of the spindle 3 for carrying the full bobbin 51 is stopped, the cylinder 35 of the partitioning mechanism 11 and the cylinder 20 of the lower yarn switching mechanism 9 are actuated to return the partitioning plates 22, 34 to the waiting positions, respectively.

Thus, the yarn switching operation is completed.

The threading operation on the empty bobbin at the beginning of the yarn winding operation in the above turret type yarn winder is conducted in such a manner that the yarn 60 continuously spun from a spinning machine (not shown) is sucked by a suction gun (not shown) and inserted into the threading guide 36 of the threading mechanism 12 while the yarn releasing guide 14 of the upper yarn switching mechanism 8 is projected, thereafter the threading guide 36 being displaced to the anchor yarn winding position. Then the threading operation is carried out by the method similar to the yarn switching operation conducted after the turret member 2 has moved to the intermediate stopping position in the yarn changing operation carried out when the yarn is changed from full bobbin 51 to the empty bobbin 50. (see FIG. 10). The difference from the yarn switching operation resides in the use of the suction gun (not shown) for sucking the yarns 60, instead of winding the same on the full bobbin 51.

When the threading operation is conducted at a yarn speed lower than a predetermined winding speed, the yarn speed is accelerated to the predetermined winding speed in synchronism with the speed of the godet roller (not shown) after the yarn 60 is initially wound on the empty bobbin.

When the predetermined winding speed is reached, the yarn is switched from a thin layer bobbin on which the yarn has been wound during the threading operation and the acceleration to another empty bobbin.

The yarn switching operation from the thin layer bobbin to the empty bobbin is quite the same as that from the full bobbin to the empty bobbin.

Figure 19:
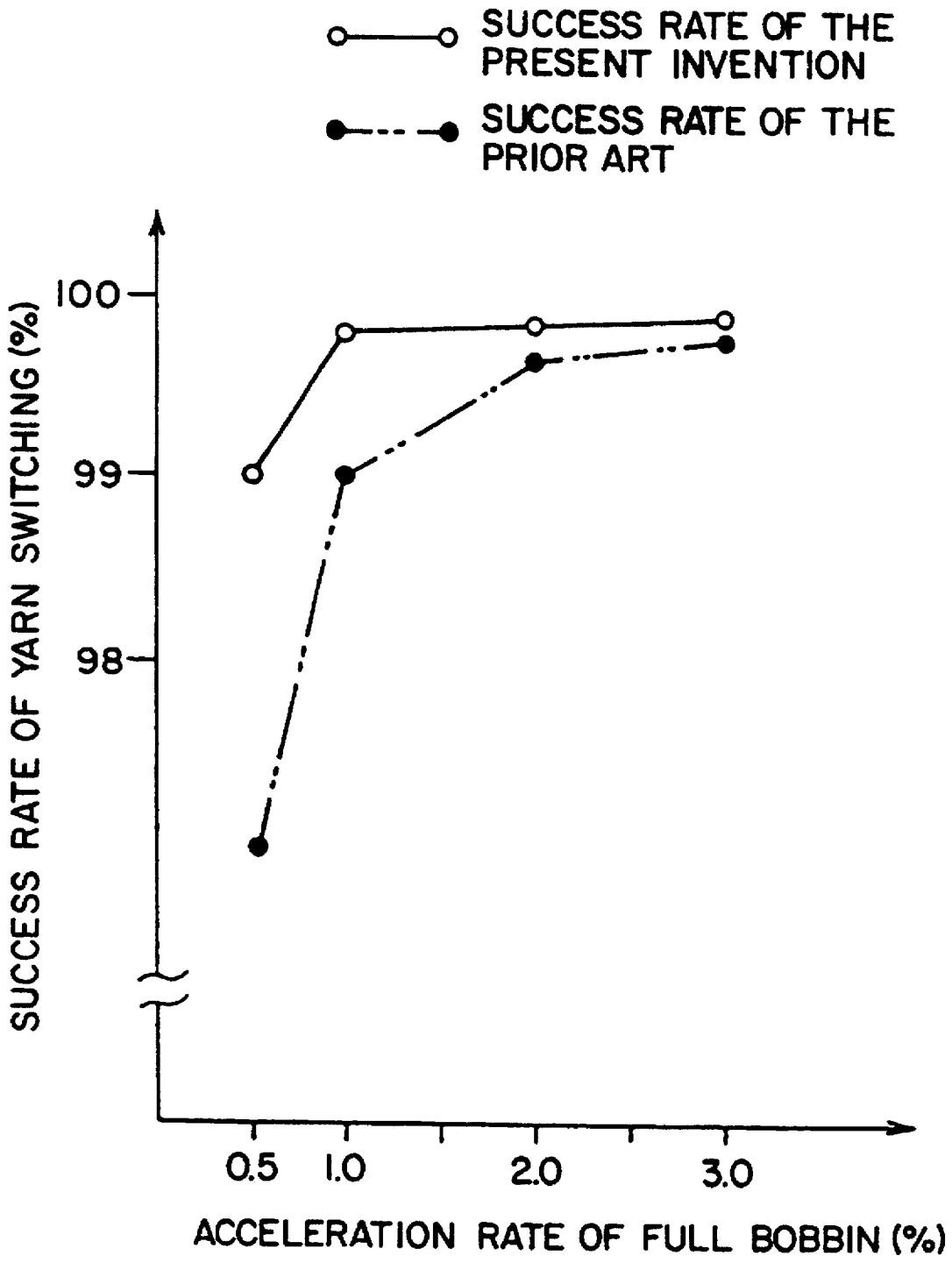
FIG. 19 is a diagram representing a relationship between the acceleration and the success rate of the yarn switching operation in the turret type yarn winder according to the present invention.

The yarn switching operation from the full bobbin 51 to the empty bobbin 50 was conducted under the following conditions. The success rate of the yarn switching operation was as shown in FIG. 19.

(Yarn Switching Conditions)

Kind of yarn: polyester filament yarn (75 denier)

Winding speed: 4,800 m/min

Acceleration rate: 0.5%, 1.0%, 2.0%, 2.5%

Outer diameter of yarn layer formed on full bobbin: 400 mm

Outer diameter of empty bobbin: 126 mm

It is apparent from FIG. 19 that, according to the turret type yarn winder of the present invention, the success rate of the yarn switching operation is substantially 100% in a range between 1.0% and 2.5% of the acceleration rate, which means that the yarn switching operation can be conducted in a more stable state compared with the conventional turret type yarn winder.

Figure 20:
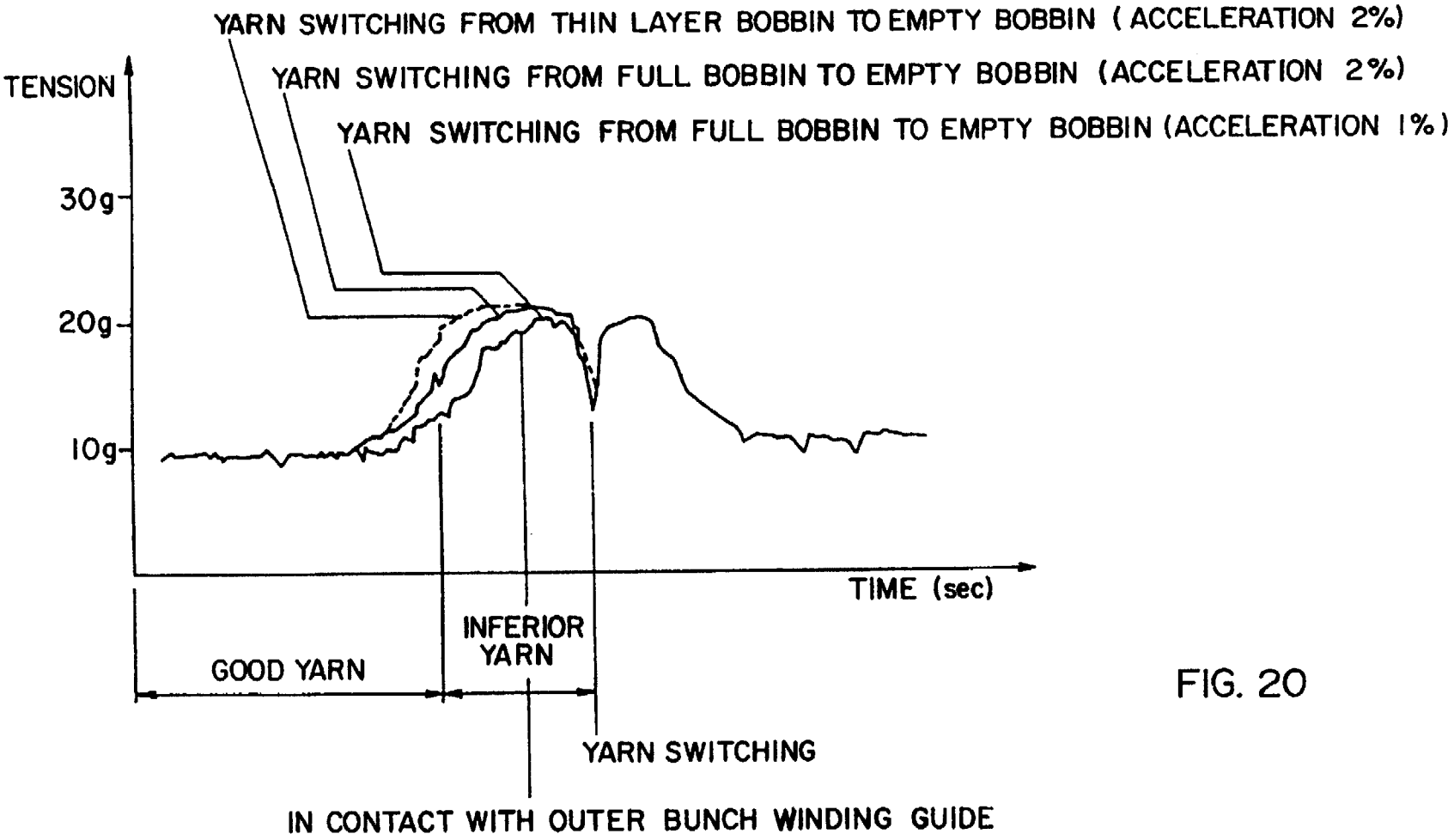
FIG. 20 is a diagram representing the tension variation during the yarn switching operation in the turret type yarn winder according to the present invention.
Figure 21:
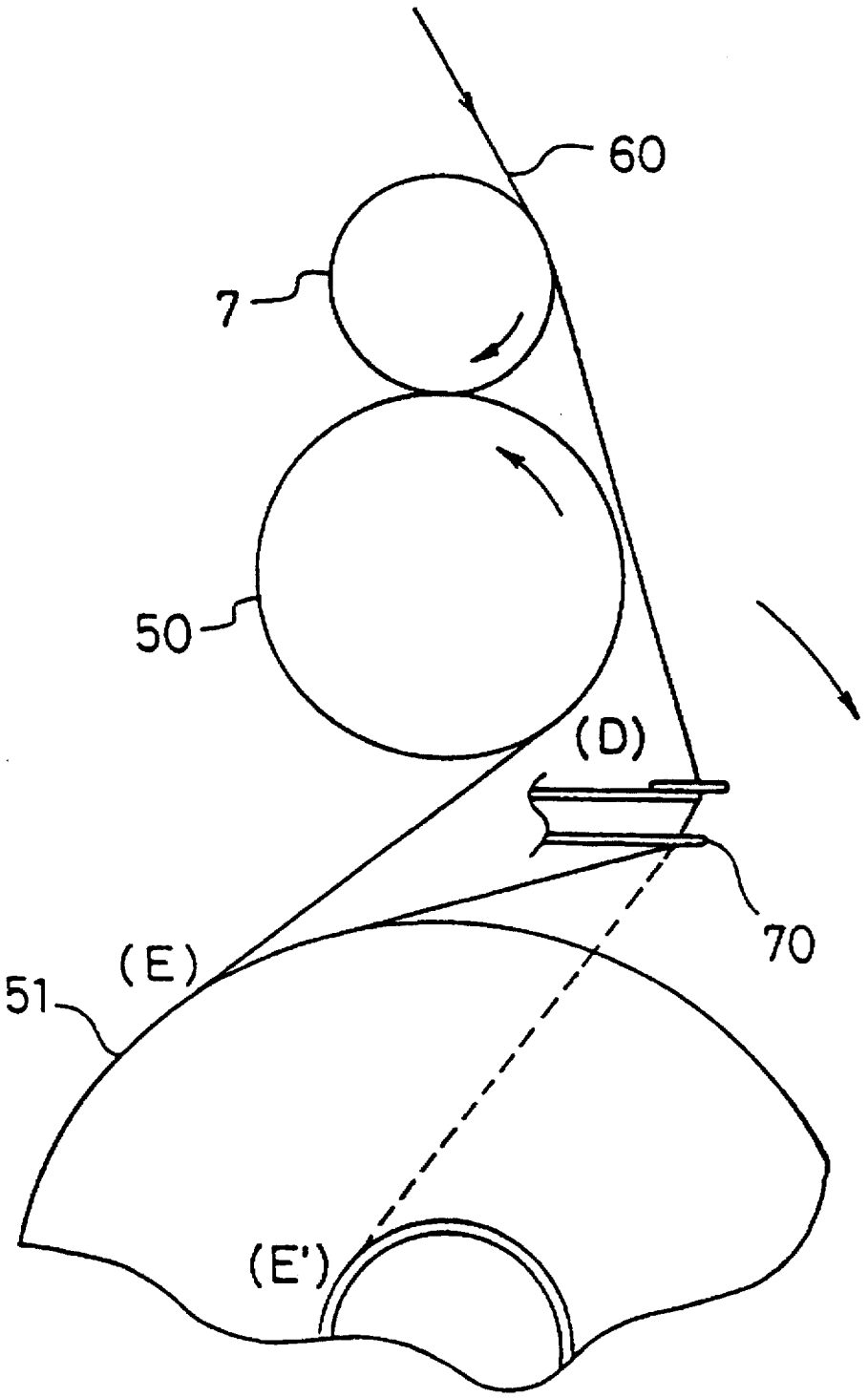
Fig. 21 PRIOR ART
FIG. 21 is a schematic view showing a yarn path during the yarn switching operation in the conventional turret type yarn winder.
Figure 22:
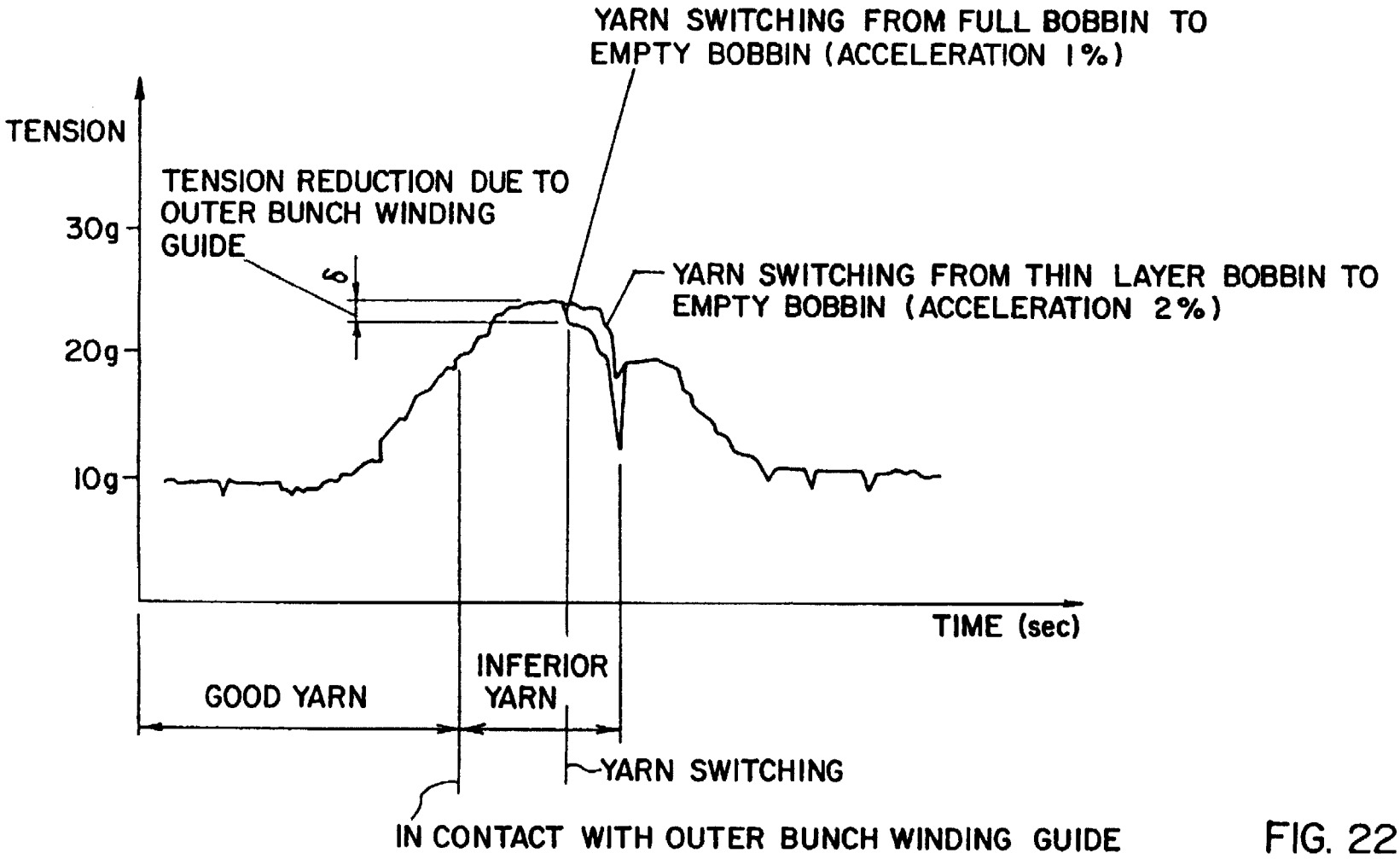
FIG. 22 (PRIOR ART)
FIG. 22 is a diagram representing the tension variation during the yarn switching operation in the conventional turret type yarn winder.

The tension variations during the yarn switching operation from the thin layer bobbin 51 to the empty bobbin 50 and that from the full bobbin to the empty bobbin are as shown in FIG. 20.

Since a degree of contact of the yarn 60 in the lower yarn switching mechanism 9 is not almost changed throughout the yarn switching operation from the thin layer bobbin to the empty bobbin under the acceleration rate of 2.0%, the tension variation is substantially the same as that in the conventional yarn switching operation from the full bobbin to the empty bobbin, until the yarn is switched to the empty bobbin, but the degree of tension reduction upon the yarn switching becomes less than that in the conventional case.

On the other hand, during the yarn switching operation from the full bobbin 51 to the empty bobbin 50, since the degree of contact of the yarn 60 in the lower yarn switching mechanism 9 is extremely small, the tension increase due to the acceleration of yarn winding speed becomes less and the tension reduction hardly occurs when the yarn is brought into contact with the outer bunch winding forming guide. Also, the tension reduction upon the yarn switching is the same as that in the yarn switching from the thin layer bobbin to the empty bobbin.

If the tension reduction in the above yarn switching operation is small, it is possible to eliminate the yarn vibration and the yarn being wrapped around the godet roller, which enhances the success rate of the yarn switching operation. This will be apparent from a graph of the success rate shown in FIG. 19.

As shown by a solid line, the tension increase due to the acceleration at the acceleration rate of 1.0% is less than that at the acceleration rate of 2.0% and also the tension variation is more gentle.

Therefore, it is possible to reduce the acceleration time during the yarn switching operation, whereby an amount of waste yarn formed in the outer yarn layer due to the acceleration can be minimized.

If an anchor yarn winding mechanism is provided on the lower yarn switching mechanism, it is possible to further reduce the tension variation when the yarn is initially wound on the empty bobbin.

The lower yarn switching mechanism includes, an outer bunch winding forming guide for forming a bunch winding by running the yarn on a predetermined position of the outermost yarn layer wound on the bobbin and a yarn searching guide for guiding the yarn running while being restricted by the upper yarn switching mechanism to a yarn catching part of the bobbin. If the outer bunch winding forming guide is adapted to be located on the empty bobbin side relative to a common tangent formed between a position formed on a circumference of an outermost yarn layer of the full bobbin and located on a forward side thereof which is relative to a rotational direction of the turret member and a position formed on a circumference of an outermost yarn layer of the empty bobbin and located on a forward side thereof which is relative to a rotational direction of the turret member, when the turret member rotates in the direction opposite to the spindle rotation to bring the empty bobbin to a yarn switching position, the contacting angle of the yarn in the lower yarn switching mechanism becomes minimum, whereby it is possible to minimize the tension reduction during the yarn switching and also decrease the rate of acceleration of spindle rotation.

Accordingly, no yarn vibration or wrapping of yarn around roller occurs, which enhances the success rate of the yarn switching and reduces the waste yarn wound in the outermost layer of the bobbin.

Further, if a yarn searching guide is displaced by a dog movably mounted to the turret member, it is possible to easily change a winding angle to a bobbin in accordance with kinds, thicknesses or winding speeds of yarns and to enhance the success rate of yarn switching by selecting an optimum winding angle.

What we claim is:

1. A turret type yarn winder comprising a turret member rotatably mounted on a machine frame and having a plurality of rotatable spindles for holding bobbins, a traverse mechanism provided above the spindles, a contact roller rotatably mounted on the machine frame or a frame of the traverse mechanism, an upper yarn switching mechanism provided upstream of the spindle located in a yarn winding position, and a lower yarn switching mechanism capable of moving into a space formed between a full bobbin on one of said spindles and an empty bobbin on another of said spindles, wherein said lower yarn switching mechanism comprises an outer bunch forming guide for guiding a running yarn to a predetermined position on the outer circumference of a yarn layer formed on the full bobbin to form a bunch winding on an outer peripheral surface of the yarn layer on the full bobbin, and a yarn searching guide for guiding the yarn running along a yarn path restricted by the upper yarn switching mechanism, to a yarn catching part of the empty bobbin, wherein when the outer bunch forming guide is displaced into a space formed between the full and empty bobbins under a condition in that the empty bobbin is moved to a yarn switching position in the vicinity of the yarn winding position due to the turret member being rotated in a direction opposite to the rotational direction of the spindles, the outer bunch forming guide is located on the empty bobbin side relative to a common tangent formed between a position formed on a circumference of an outermost yarn layer of the full bobbin and located on a forward side thereof with respect to a rotational direction of the turret member and a position formed on a circumference and a position formed on a circumference of an outermost yarn layer of the empty bobbin and located on a forward side thereof with respect to a rotational direction of the turrel member.

2. A turret type yarn winder as defined by claim 1, wherein the yarn searching guide is displaced by a dog portion movably mounted to the turret member.

3. A turret type yarn winder as defined by claim 1, wherein said lower yarn switching mechanism further comprises a partitioning plate having a yarn guide section and a yarn searching guide rotatably mounted on said partitioning plate.

* * * * *

UNITED STATES PATENT AND TRADEMARK OFFICE

CERTIFICATE OF CORRECTION

PATENT NO. : 5,716,016
DATED : February 10, 1998
INVENTOR(S) : Iwade et al.

It is certified that error appears in the above-identified patent and that said Letters Patent is hereby corrected as shown below:

Column 2, line 21, before "empty" delete "bobbin" and after "empty" insert --bobbin-- therefor Column 2, line 26, delete " (θ)\" and insert --(δ )-- therefor Column 3, line 36, delete "current" and insert --turret-- therefor Column 5, line 28, after "6a" insert --FIG. 15--

Column 5, line 31, after "6a" delete "FIG. 15"

UNITED STATES PATENT AND TRADEMARK OFFICE

CERTIFICATE OF CORRECTION

PATENT NO. : 5,716,016
DATED : February 10, 1998
INVENTOR(S) : Iwade et al.

It is certified that error appears in the above-identified patent and that said Letters Patent is hereby corrected as shown below:

Column 6, line 34, delete "28, when" and insert --28. When-- therefor

Column 7, line 36, delete "conv" and insert

--conveyed to a position of the-- therefor

Column 10, line 66, delete "turrel" and insert

--turret-- therefor

Signed and Sealed this

Thirteenth Day of October 1998

*Attest:*

*Attesting Officer*

BRUCE LEHMAN

*Commissioner of Patents and Trademarks*